US010751597B2

(12) United States Patent
Chen

(10) Patent No.: US 10,751,597 B2
(45) Date of Patent: Aug. 25, 2020

(54) BOXING PRACTICE DEVICE

(71) Applicant: Pang Mei Sport Co., Ltd., Changhua County (TW)

(72) Inventor: Chih-Lung Chen, Changhua County (TW)

(73) Assignee: PANG MEI SPORT CO., LTD., Changhua County (TW)

( * ) Notice: Subject to any disclaimer, the term of this patent is extended or adjusted under 35 U.S.C. 154(b) by 41 days.

(21) Appl. No.: 16/197,972

(22) Filed: Nov. 21, 2018

(65) Prior Publication Data

US 2020/0155913 A1 May 21, 2020

(51) Int. Cl.
*A63B 69/20* (2006.01)

(52) U.S. Cl.
CPC ..... *A63B 69/205* (2013.01); *A63B 2209/10* (2013.01); *A63B 2210/50* (2013.01); *A63B 2225/09* (2013.01); *A63B 2244/102* (2013.01)

(58) Field of Classification Search
CPC ..... A63B 2244/102; A63B 69/20–325; A63B 21/169
See application file for complete search history.

(56) References Cited

U.S. PATENT DOCUMENTS 4,093,212 A * 6/1978 Jacques ..... A63B 69/20 482/129
D277,592 S * 2/1985 Jackson ..... D21/798
2006/0025285 A1* 2/2006 Giusti ..... A63B 69/201 482/83
2008/0300116 A1* 12/2008 Eder ..... A63B 21/156 482/100
2012/0238415 A1* 9/2012 Crawford ..... A63B 69/205 482/87
2013/0085044 A1* 4/2013 Chen ..... A63B 69/20 482/87
2015/0273307 A1* 10/2015 Karimi ..... A63B 69/203 482/8
2017/0348577 A1* 12/2017 Chen ..... A63B 69/20
2018/0161657 A1* 6/2018 Direnzo ..... A63C 19/00

FOREIGN PATENT DOCUMENTS

TW 353972 U 3/1999

* cited by examiner

*Primary Examiner* — Loan B Jimenez
*Assistant Examiner* — Thao N Do
(74) *Attorney, Agent, or Firm* — Muncy, Geissler, Olds & Lowe, P.C.

(57) ABSTRACT

A boxing practice device is provided, including: a support body, including a first support rod, a second support rod which is lateral to the first support rod and a base, the first support rod swingably positioned on the base, the second support rod movably positioned on the first support rod, the second support rod extending along a first rotation axis; a boxing mechanism, including a first boxing member and at least one second boxing member, the first boxing member being rotatably attached to the second support rod and rotatable about the first rotation axis, the at least one second boxing member being detachably assembled to the second support rod.

8 Claims, 6 Drawing Sheets

BOXING PRACTICE DEVICE

BACKGROUND OF THE INVENTION

Field of the Invention

The present invention relates to a boxing practice device.

Description of the Prior Art

In the structure improvement of a boxing practice device disclosed in TW353972, only a target is provided, so a user cannot practice boxing from different directions and angles, and it is inconvenient and costly that the user needs to use many types of boxing practice devices to complete his/her actual practice process. In addition, an adjusting rod is fixed on a base vertically, and the adjusting rod cannot swing relative to the base, so it is inconvenient to store the boxing practice device.

The present invention has arisen to mitigate and/or obviate the afore-described disadvantages.

SUMMARY OF THE INVENTION

The major object of the present invention is to provide a boxing practice device, which provides a first support rod swingable relative to a base to be optionally positioned on a predetermined position and has different types of boxing members and mounting modes for various practice needs.

To achieve the above and other objects, a boxing practice device is provided, including: a support body, including a first support rod, a second support rod which is lateral to the first support rod and a base, the first support rod swingably positioned on the base, the second support rod movably positioned on the first support rod, the second support rod extending along a first rotation axis; a boxing mechanism, including a first boxing member and at least one second boxing member, the first boxing member being rotatably attached to the second support rod and rotatable about the first rotation axis, the at least one second boxing member being detachably assembled to the second support rod.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
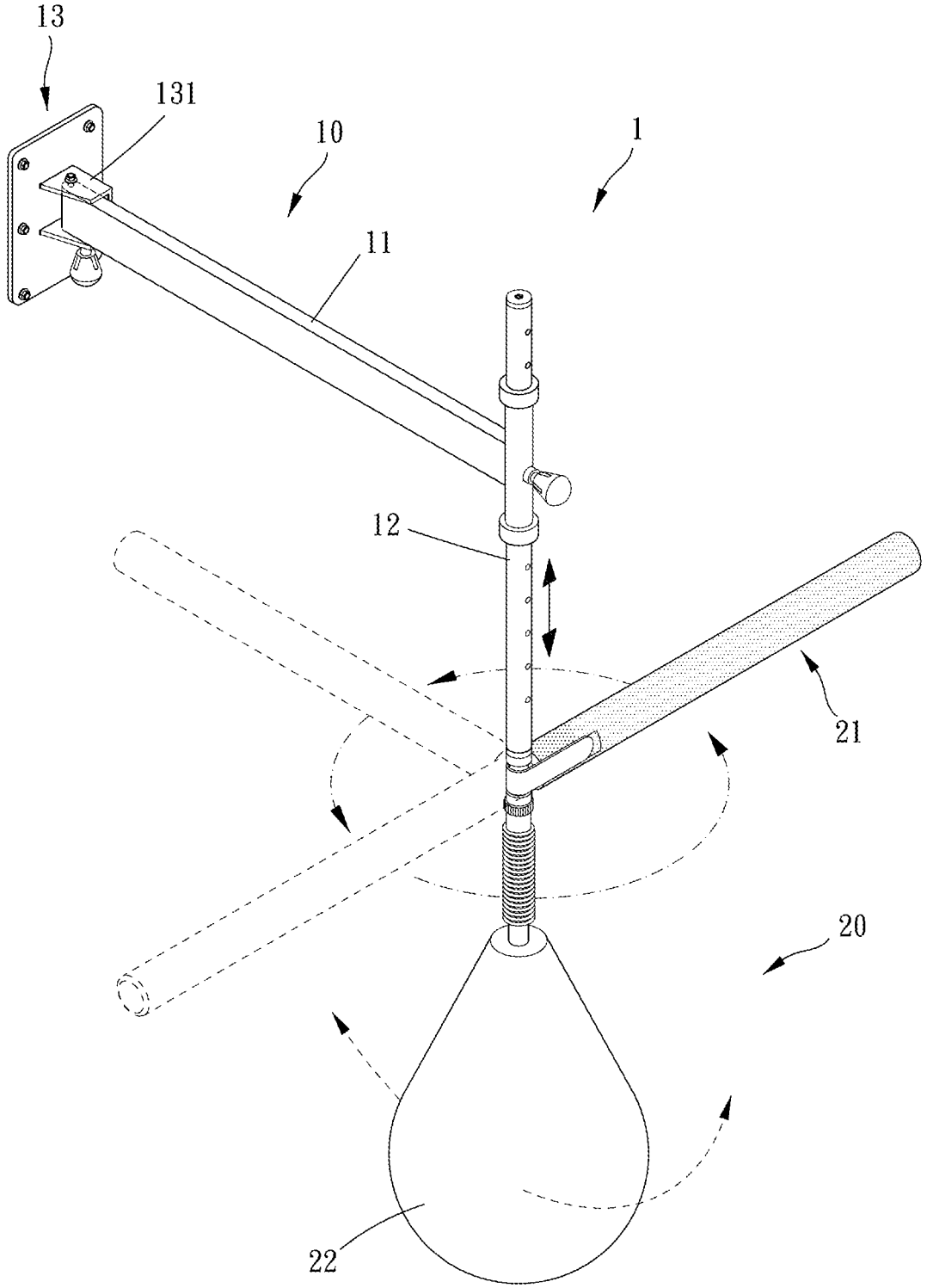
FIG. 1 is a stereogram of a first preferred embodiment of the present invention.
Figure 2:
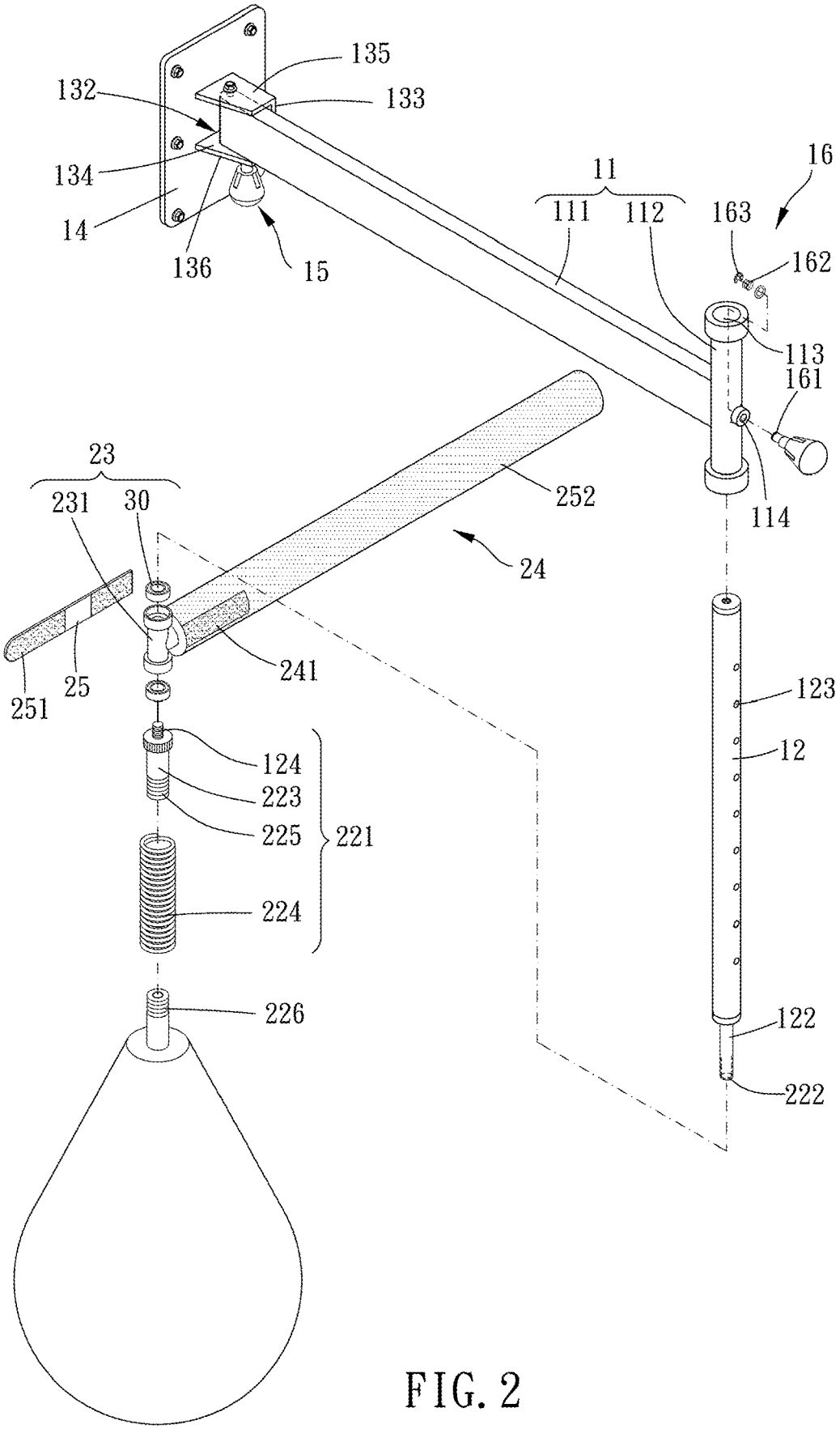
FIG. 2 is a breakdown view of the first preferred embodiment of the present invention.
Figures 3, 3A, 4:
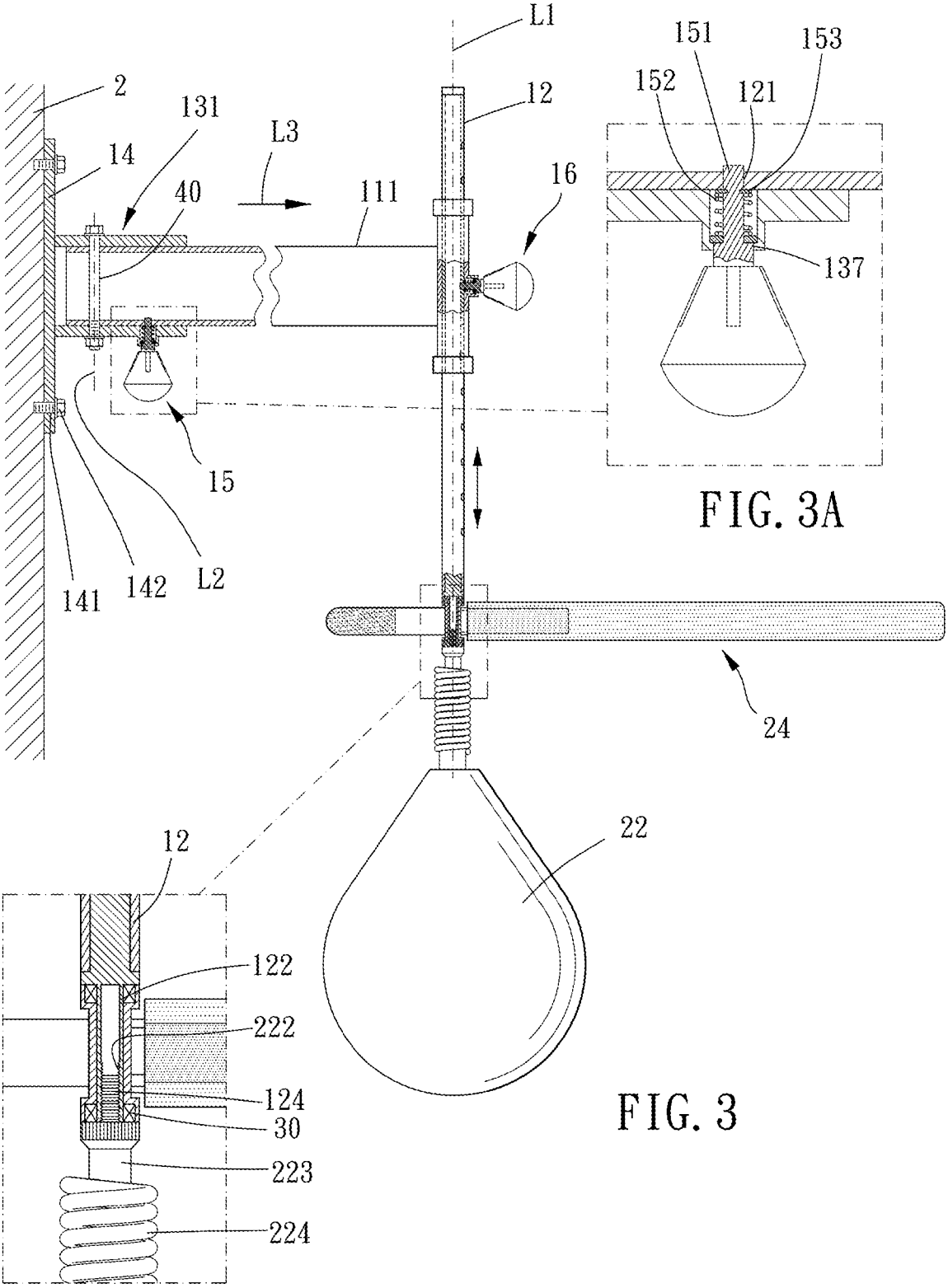
FIG. 3 is a cross-sectional view of the first preferred embodiment of the present invention.
FIG. 3A is a partially-enlarged view of FIG. 3.
FIG. 4 is another partially-enlarged view of FIG. 3.

The present invention will be clearer from the following description when viewed together with the accompanying drawings, which show, for purpose of illustrations only, the preferred embodiment in accordance with the present invention.

Please refer to FIGS. 1 to 7 for a preferred embodiment of the present invention. A boxing practice device 1 includes a support body 10 and a boxing mechanism 20.

The support body 10 includes a first support rod 11, a second support rod 12 which is lateral to the first support rod 11 and a base 13, the first support rod 11 is swingably positioned on the base 13, the second support rod 12 is movably positioned on the first support rod 11, and the second support rod 12 extends along a first rotation axis L1; the boxing mechanism 20 includes a first boxing member 21 and at least one second boxing member 22, the first boxing member 21 is rotatably attached to the second support rod 12 and rotatable about the first rotation axis L1, the at least one second boxing member 22 is detachably assembled to the second support rod 12 so that a height is adjustable, and the first support rod 11 is optionally swingable to a predetermined position, and there are various types of boxing members and assembling modes to meet different practice needs. The predetermined position may be, for example, expanding the first support rod to or collapsing the first support rod, but not limited thereto. In addition, the first boxing member 21 is detachably attached to the second support rod 12. In other embodiments, the first support rod is swingable and positionable relative to the base in a multi-stage way.

The boxing practice device 1 further defines a second rotation axis L2, the second rotation axis L2 passes through the base 13 and the first support rod 11, the first support rod 11 rotates about the second rotation axis L2, the first support rod 11 extends in a first direction L3, and the first direction L3 is lateral to the second rotation axis L2; specifically, the base 13 further includes a frame body 131, the frame body 131 is C-shaped, the frame body 131 has a receiving groove 132, the first support rod 11 is inserted in the receiving groove 132, the frame body 131 further includes a side wall 133 and an opening 134 which communicates with the receiving groove 132, the first support rod 11 is abuttable against the side wall 133 on a direction lateral to the first direction L3 and is swingable out of the receiving groove 132 through the opening 134, and preferably, the side wall 133 and the opening 134 are on two opposite sides of the frame body 131 to elevate a support strength and restrict the first support rod 11 to swing along a single direction. In addition, the boxing practice device 1 further includes an inserting pin 40, the inserting pin 40 is disposed through the frame body 131 and the first support rod 11, and the inserting pin 40 extends along the second rotation axis L2. In this embodiment, the frame body 131 further includes an upper wall 135 and a lower wall 136, and the inserting pin 40 is disposed through the upper wall 135 and the lower wall 136 to improve the support effect. Furthermore, the base 13 further includes a base plate 14, the base plate 14 is for detachably disposed on a base face 2, in this embodiment, the base face 2 is a wall, and the base plate 14 is detachably fixed on the base face 2 to be hung thereon and stably positioned; in other embodiments, the base face may be a ground surface or other support surfaces. The frame body 131 extends lateral to the base plate 14 and has better support strength. Specifically, the support body 10 further includes an elastic engaging mechanism 15, the frame body 131 has a first through hole 137, the first support rod 11 has a second through hole 121, and the elastic engaging mechanism 15 is positionably disposed through the first through hole 137 and elastically engaged with the second through hole 121 to be quickly disconnected and to be positionably engaged. More specifically, the elastic engaging mechanism 15 includes a pin portion 151, an elastic member 152 and a C-ring 153, the pin portion 151 is disposed through the first through hole 137 and retractably inserted into the second through hole 121, the C-ring 153 is arranged on the pin portion 151, and the elastic member 152 abuts against and between the pin portion 151 and the C-ring 153 to provide the function of elastically reposition and positionably insertion. The base plate 14 includes a plurality of through holes 141 disposed beside the frame body 131, and the plurality of through holes 141 are open at a side of the base plate 14 facing toward the second rotation axis L2 and for fixation to the base face 2 with fasteners 142.

It is to be noted that the first boxing member 21 includes a first mounting portion 23, a first boxing portion 24 which is laterally assembled to the first mounting portion 23 and a fastening member 25, the first mounting portion 23 is rotatably attached to the second support rod 12, the fastening member 25 includes two connecting portions 251, and the fastening member 25 is disposed around the first mounting portion 23 with the two connecting portions 251 connected to two opposite sides of the first boxing portion 24. Preferably, at least one of the two connecting portions 251 is detachably connected to the first boxing portion 24, in this embodiment, the two connecting portions 251 are detachably connected to the first boxing portion 24 to elevate a connecting stability of the first boxing portion 24 and the first mounting portion 23 and to quickly assemble or disassemble the first boxing portion 24 and the first mounting portion 23. In this embodiment, the first boxing member 24 has two buckle members 241, and a Velcro fastener mechanism is disposed on at least one of the two connecting portions 251 and at least one of the two buckle members 241. For example, one of each said connecting portion 251 and each said buckle member 241 is a male Velcro, and the other of each said connecting portion 251 and each said buckle member 241 is a female Velcro which is detachably stuck to the male Velcro. In other embodiments, each said buckle member and each said connecting member may be engaging structures like a male-female hook fastener or a male-female clinching fastener; in addition, an outer circumference of the first boxing member may be wrapped with a fluff fabric so that each said connecting member can be directly and detachably stuck thereon (for example, a Velcro). The first boxing portion 24 further has a buffering exterior layer 252 to provide a buffering effect.

Moreover, the second support rod 12 has an assembling portion 122, the first mounting portion 23 has a socket 231 which is detachably sleeved to the assembling portion 122 and a plurality of bearings 30, each of the plurality of bearings 30 is disposed between the socket 231 and the assembling portion 122, and the first boxing portion 24 is laterally connected to the socket 231 so that the first boxing member 21 can rotate smoothly.

In addition, the first support rod 11 is T-shaped, the first support rod 11 further includes a horizontal section 111 which is disposed to the base 13 and a vertical section 112, and the second support rod 12 is disposed to the vertical section 112. The vertical section 112 is a tube body, the tube body has a penetrating hole 113 which extends toward the first rotation axis L1, and the second support rod 12 is disposed through the penetrating hole 113 to provide stable support so that a length can be adjusted smoothly.

In this embodiment, the support body 10 further includes an elastic pin member 16, the first support rod 11 has a first hole 114, the second support rod 12 has a plurality of second holes 123 which are spacingly arranged, and the elastic pin member 16 is positionably disposed within the first hole 114 and elastically engaged with one of the plurality of second holes 123. Specifically, the elastic pin member 16 includes an inserting portion 161, a spring 162 and a C-shaped fastener 163, the elastic pin member 16 is disposed through the first hole 114 and retractably inserted into one of the plurality of second holes 123, the C-shaped fastener 163 is arranged on the inserting pin portion 161, and the spring 162 abuts against and between the inserting portion 161 and the C-shaped fastener 163 so as to quickly adjust positions and heights of the first boxing member 21 and each of the at least one second boxing member 22.

Each of the at least one second boxing member 22 further includes a second mounting portion 221, one of the second mounting portion 221 and the assembling portion 122 has a threaded hole, and the other of the second mounting portion 221 and the assembling portion 122 has a threaded rod which is screwed to the threaded hole; in this embodiment, the second mounting portion 221 has the threaded hole 222, and the assembling portion 122 has the threaded rod 124. Each of the at least one second boxing member 22 includes a rod body 223 and a spiral elastic member 224, the rod body 223 has the second mounting portion 221 and a first exterior threaded section 225, the second boxing member 22 extends and has a second exterior threaded section 226 thereon, and the spiral elastic member 224 is screwed to and between the first and second exterior threaded sections 225, 226 respectively; in other embodiments, the second boxing member and the spiral elastic member may be engaged with each other in a concave-convex structure. The second boxing member can receive a force to elastically swing relative to the second mounting portion 221 and return to an initial position.

The first support rod 11, the second support rod 12, the first boxing member 21 and the second boxing member 22 are on the same plane P; that is, the first support rod 11, the second support rod 12, the first boxing member 21 and the second boxing member 22 can be adjusted to the same plane P. Specifically, central axes of the first support rod 11, the first boxing member 21 and the second boxing member 22 are on the same plane P to decrease an overall volume.

Figure 8:
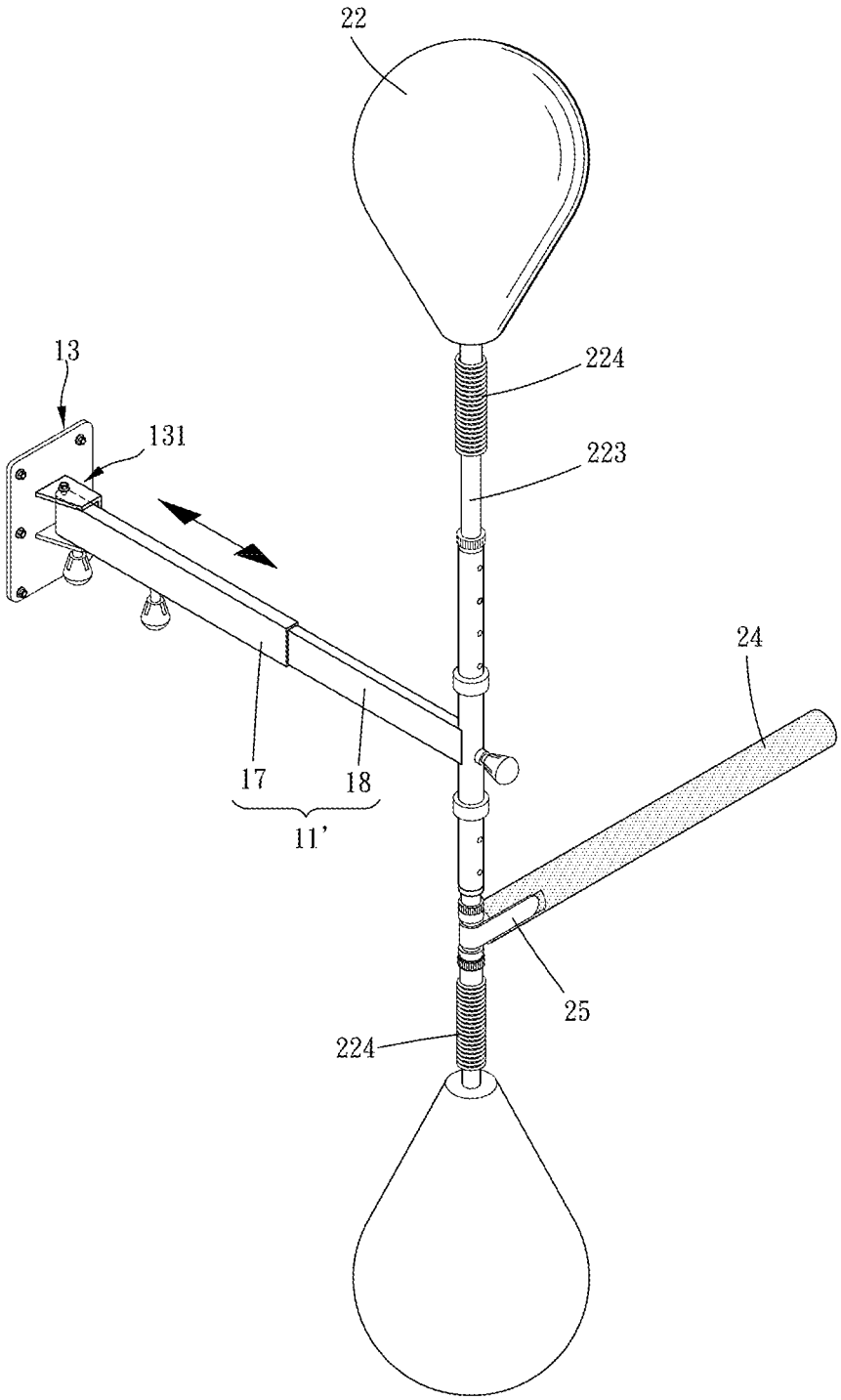
FIG. 8 is a stereogram of a second preferred embodiment of the present invention.

Please refer to FIG. 8, a number of the at least one second boxing member 22 is two, the two second boxing members 22 are detachably assembled to two opposite sides of the second support rod 12, in this embodiment, the two second boxing members 22 are optionally screwed to one of two ends of the second support rod 12 so that a plurality of the second boxing members 22 can be provided, and each of the two second boxing members 22 can be assembled on various positions to provide many practice modes. In addition, the first support rod 11' is a retractable rod, and the retractable rod includes a first tube member 17 and a second tube member 18 which is retractable and positionable relative to the first tube member 17; in other embodiments, the retractable rod is a hydraulic rod, the first tube member and the second tube member may respectively have a plurality of positioning holes, and a positioning pin may be inserted through respective one of the plurality of positioning holes of the first tube member and the second tube member.

Figure 5:
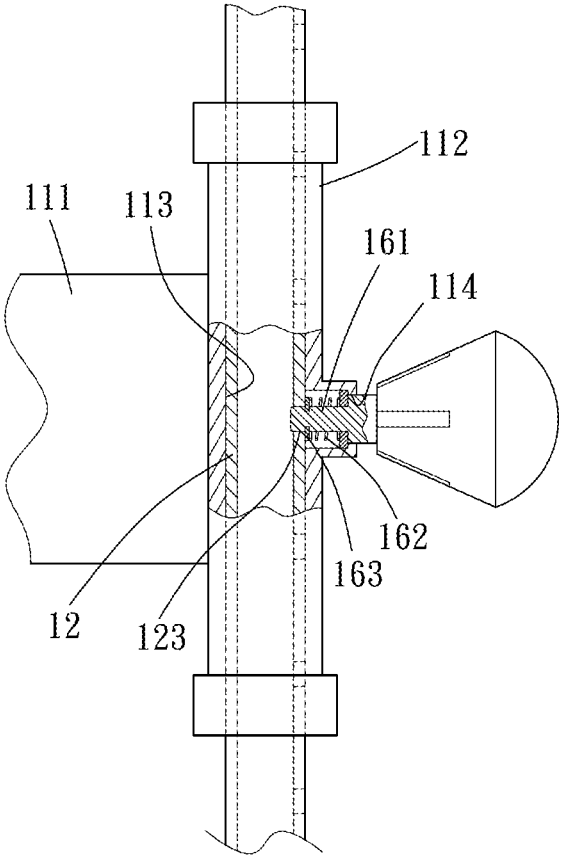
FIGS. 5 and 6 are partially cross-sectional views showing the first preferred embodiment of the present invention in use.
Figure 6:
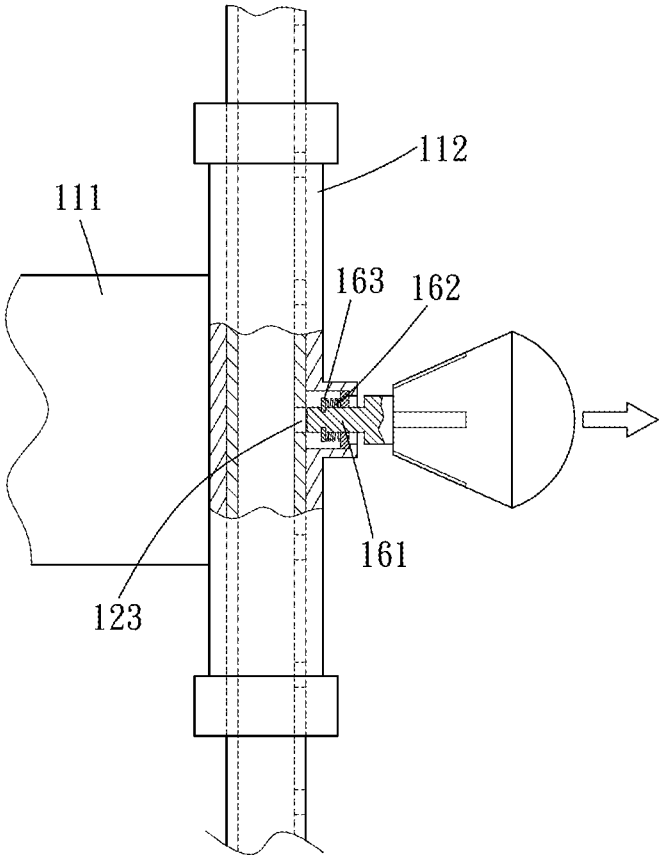
Figure 7:
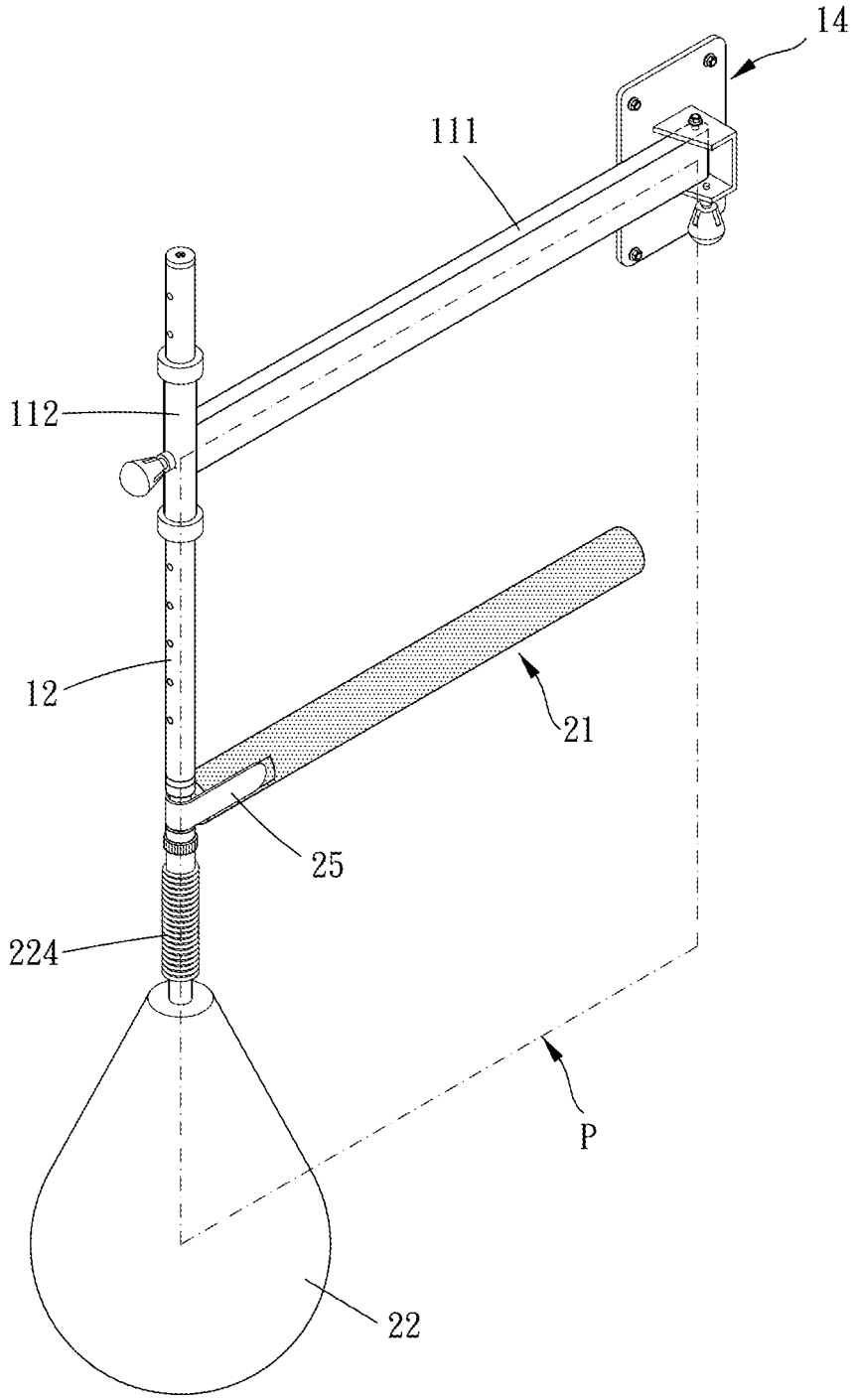
FIG. 7 is a drawing showing the first preferred embodiment of the present invention being collapsed.

In actual practice, the first support rod 11 can optionally swing between a first position (for example, a storage position) and a second position (for example, a usage position) to be minimized for storage (as shown in FIG. 5) or expanded for usage (as shown in FIG. 1); the second support rod 12 can move relative to the first support rod 11 to adjust the first boxing member 21 and the second boxing member 22; in addition, each of the at least one second boxing member 22 can be optionally assembled to or disassembled from the second support rod 12. Given the above, the height of the boxing practice device can be adjusted, the first support rod can optionally swing to a predetermined position, and the boxing practice device has various boxing member and assembling modes to meet different practice needs.

While we have shown and described various embodiments in accordance with the present invention, it should be clear to those skilled in the art that further embodiments may be made without departing from the scope of the present invention.

What is claimed is:

1. A boxing practice device, including:

a support body, including a first support rod, a second support rod which is lateral to the first support rod and a base, the first support rod swingably positioned on the base, the second support rod movably positioned on the first support rod, the second support rod extending along a first rotation axis;

a boxing mechanism, including a first boxing member and at least one second boxing member, the first boxing member being rotatably attached tote second support rod and rotatable about the first rotation axis, the at least one second boxing member being detachably assembled to the second support rod;

wherein a second rotation axis which passes through the base and the first support rod is defined, the first support rod is rotatable about the second rotation axis, the first support rod extends in a first direction, and the first direction is lateral to the second rotation axis;

wherein the base includes a base plate for being detachably disposed on a base face, the base plate faces radially relative to the second rotation axis, the base further includes a frame body having a receiving groove, the first support rod is inserted in the receiving groove, the frame body includes a side wall, an upper wall and a lower wall, the side wall, the upper wall and the lower wall respectively extend radially relative to the second rotation axis from the base plate, the side wall extends laterally from the base plate and is connected with respective edges of the upper and lower walls, and the first support rod is abuttable against the side wall or abuttable against the base plate on a direction lateral to the first direction;

wherein the base plate includes a plurality of through holes disposed beside the frame body, and the plurality of through holes are open at a side of the base plate facing toward the second rotation axis and for fixation to the base face with fasteners.

2. The boxing practice device of claim 1, further including an inserting pin, the inserting pin disposed through the frame body and the first support rod, the inserting pin extending along the second rotation axis.

3. The boxing practice device of claim 1, wherein the support body further includes an elastic engaging mechanism, the frame body has a first through hole, the first support rod has a second through hole, and the elastic engaging mechanism is positionably disposed through the first through hole and elastically engaged with the second through hole.

4. The boxing practice device of claim 1, wherein the first boxing member includes a first mounting portion, a first boxing portion which is laterally assembled to the first mounting portion and a fastening member, the first mounting portion is rotatably attached to the second support rod, the fastening member includes two connecting portions, and the fastening member is disposed around the first mounting portion with the two connecting portions connected to two opposite sides of the first boxing portion.

5. The boxing practice device of claim 4, wherein at least one of the two connecting portions is detachably connected to the first boxing portion.

6. The boxing practice device of claim 1, wherein the at least one second boxing member comprises two second boxing members, and the two second boxing members are detachably assembled to two opposite sides of the second support rod.

7. The boxing practice device of claim 1, wherein the support body further includes an elastic pin member, the first support rod has a first hole, the second support rod has a plurality of second holes which are spacingly arranged, and the elastic pin member is positionably disposed within the first hole and elastically engaged with one of the plurality of second holes.

8. The boxing practice device of claim 1, wherein the support body further includes an elastic engaging mechanism, the frame body has a first through hole, the first support rod has a second through hole, and the elastic engaging mechanism is positionably disposed through the first through hole and elastically engaged with the second through hole; the first boxing member includes a first mounting portion, a first boxing portion which is laterally assembled to the first mounting portion and a fastening member, the first mounting portion is rotatably attached to the second support rod, the fastening member includes two connecting portions, and the fastening member is disposed around the first mounting portion with the two connecting portions connected to two opposite sides of the first boxing portion; the first boxing member has two buckle members, a Velcro fastener mechanism is disposed on at least one of the two connecting portions and at least one of the two buckle members; the second support rod has an assembling portion, the first mounting portion has a socket which is detachably sleeved to the assembling portion and a plurality of bearings, each of the plurality of bearings is disposed between the socket and the assembling portion, and the first boxing portion is laterally connected to the socket; the at least one connecting portion is detachably connected to the first boxing portion; the first support rod is T-shaped, the first support rod further includes a horizontal section which is disposed to the base and a vertical section, and the second support rod is disposed to the vertical section; the vertical section is a tube body, the tube body has a penetrating hole which extends toward the first rotation axis, and the second support rod is disposed through the penetrating hole; the support body further includes an elastic pin member, the first support rod has a first hole, the second support rod has a plurality of second holes which are spacingly arranged, and the elastic pin member is positionably disposed within the first hole and elastically engaged with one of the plurality of second holes; the side wall and an opening of the frame body are located on two opposite sides of the frame body; the inserting pin is disposed through the upper wall and the lower wall; each of the at least one second boxing member further includes a second mounting portion, one of the second mounting portion and the assembling portion has a threaded hole, and the other of the second mounting portion and the assembling portion has a threaded rod which is screwed to the threaded hole; each of the at least one second boxing member includes a rod body and a spiral elastic member, the rod body has the second mounting portion and a first exterior threaded section, the second boxing member extends and has a second exterior threaded section thereon, and the spiral elastic member is screwed to and between the first and second exterior threaded sections respectively; the elastic engaging mechanism includes a pin portion, an elastic member and a C-ring, the pin portion is disposed through the first through hole and retractably inserted into the second through hole, the C-ring is arranged on the pin portion, and the elastic member abuts against and between the pin portion and the C-ring; the elastic pin member includes an inserting portion, a spring and a C-shaped fastener, the elastic pin member is disposed through the first hole and retractably inserted into one of the plurality of second holes, the C-shaped fastener is arranged on the inserting pin portion, and the spring abuts against and between the inserting portion and the C-shaped fastener; the first support rod is a retractable rod, and the retractable rod includes a first tube member and a second tube member which is retractable and positionable relative to the first tube member; the first support rod, the second support rod, the first boxing member and the second boxing member are on the same plane.

* * * * *